US006412237B1

(12) United States Patent
Sahai

(10) Patent No.: US 6,412,237 B1
(45) Date of Patent: Jul. 2, 2002

(54) FRAMED STRUCTURES WITH COUPLED GIRDER SYSTEM AND METHOD FOR DISSIPATING SEISMIC ENERGY

(75) Inventor: Rajendra Sahai, Berkeley, CA (US)

(73) Assignee: Structural Design Engineers, San Francisco, CA (US)

( * ) Notice: Subject to any disclaimer, the term of this patent is extended or adjusted under 35 U.S.C. 154(b) by 0 days.

(21) Appl. No.: 09/454,487

(22) Filed: Dec. 3, 1999

(51) Int. Cl.[7] ..... E04B 1/98
(52) U.S. Cl. ..... 52/167.1; 52/690; 52/655.1
(58) Field of Search ..... 52/167.3, 167.1, 52/236.6, 650.1, 655.1, 690, 741.3

(56) References Cited

U.S. PATENT DOCUMENTS 1,418,297 A * 6/1922 Goodrich ..... 52/167.1
3,461,636 A * 8/1969 Hern ..... 52/167.1
5,375,382 A * 12/1994 Weidlinger ..... 52/167.3
5,595,040 A * 1/1997 Chen ..... 52/167.1
5,660,017 A * 8/1997 Houghton ..... 52/167.3
5,675,943 A * 10/1997 Southworth ..... 52/167.1
5,720,571 A * 2/1998 Frobosilo ..... 52/167.1

* cited by examiner

*Primary Examiner*—Beth A. Stephan
(74) *Attorney, Agent, or Firm*—Skjerven Morrill LLP

(57) ABSTRACT

An improved framed structure incorporating a coupled-girder system provides enhanced seismic energy dissipation by as much as 30% over that provided by conventional yielding of the girders. The coupled-girder system includes a pair of spaced-apart girders coupled by one or more girder-to-girder links which are preferably vertical links. Energy dissipation takes place when the structure drifts beyond its elastic limit and the differential displacement of the pair of girders causes the web of each vertical link to shear yield. The links are proportioned to remain in the elastic regime under wind loads and moderate earthquakes as prescribed by building codes. Beyond the elastic limit, preferably the yielding in the links will take place prior to that in the girders. In this way, the links will be the first line of defense for dissipating seismic energy before the girders themselves. The other advantages of the coupled-girder system are improved effective stiffness of the column and girders and ease of post-earthquake inspection and repair of the vertical links.

25 Claims, 6 Drawing Sheets

FRAMED STRUCTURES WITH COUPLED GIRDER SYSTEM AND METHOD FOR DISSIPATING SEISMIC ENERGY

FIELD OF THE INVENTION

This invention relates to architectural framed structures and methods in general, and more particularly to ones having a coupled girder system capable of dissipating seismic energies.

BACKGROUND OF THE INVENTION

Framed structures have been used for centuries in building construction. Most typically, they are in the form of a rigid frame, utilizing rigid couplings between columns and girders. Buildings in seismically active locations are likely to be subject to oscillatory (i.e., repeated back and forth) lateral forces or lateral shaking during an earthquake. The rigid frame forms a moment frame that provides a building with resistance to lateral forces by the stiffness of the columns and girders and the rigid connection between them.

FIG. 1 illustrates a cross-sectional view of a modern steel I-beam that is used to form columns and girders of a framed structure. The head and foot sections of the "I" is known as the "flanges", and connecting them in between is the body section known as the "web". A steel I-beam comes in various dimensions as classified by the American Institute of Steel Construction. For example a W24 I-beam would be a wide flange rolled steel with a nominal depth of 24 inches from head to foot.

FIG. 2 illustrates a conventional framed structure formed by a lattice of columns and girders. One modern example of such a structure is the Special Moment Resisting Frame ("SMRF"). For simplicity only two columns and two girders are shown, even though in general the lattice formed is a three-dimensional one. In a framed structure, a girder is coupled to a column at an angle, typically at right angle, to form a rigid moment connection.

In the early part of the twentieth century, the I-beams were joined together using rivets that connected both the web as well as the flanges of the girder to the column. Angles or bent plates were used to transfer the forces from the girder flange to the column flanges. Later, with the advent of welding technology, the girder-to-column rigid moment connections were made utilizing the technique of welding the girder flange to the column flange. The girder webs were traditionally bolted using high strength bolts.

When a force is applied to a rigid material such as steel, there is a "stress" on the material which results in a displacement or "strain". The characteristics of steel ante such that the stress-strain relation is initially in a linear or ("elastic") regime where the strain is proportional to the stress. Furthermore, the process is reversible in that the strain is reduced in proportion with the stress by retracing the linear relation. Since, energy is given by integrating the applied force over the displacement, it is equivalent to the area under the stress-strain curve. In the elastic regime, as force is applied, energy is stored in the rigid material, but when the force is removed, the energy stored as strain energy is translated into kinetic energy (i.e., movement of the frame). Thus, there is no dissipation or removal of energy from the material.

On the other hand, when the stress exceeds a certain value for a given material where the resulting strain is beyond a certain point called the "yield" point, the material enters into a regime where it starts to yield inelastically. Here, the stress-strain relation begins to deviate from a linear relation. More importantly, in the inelastic regime the process is irreversible in that the stress-strain curve is not retraced as the stress is subsequently decreased. Thus, in the inelastic regime the energy stored in the material is dissipated as heat instead of kinetic energy during the yielding of the material. Since the heat escapes to the outside environment, this energy is then permanently lost from the material which allows the motions to die out. This phenomenon is called "damping".

FIGS. 3A–3C illustrates schematically the behavior of a simple conventional framed structure in response to lateral forces. FIG. 3A is a schematic representation of a simple conventional framed structure formed by a girder supported by two columns. FIG. 3B illustrates schematically the deformation to the conventional framed structure of FIG. 3A in response to a force from left to right. The moment frame rotates clockwise resulting in a deformation of the girder which tries to maintain at right angle at the joints to the columns. The stress and strain in the girder is flexural in nature without any net load along the long axis of the girder (axial load). At the right end of the girder, the stress in the top half portion is compressive and the stress in the bottom halfportion is tensile. At the left end of the girder, the reverse is the case. Similarly, FIG. 3C illustrates schematically the deformation to the conventional framed structure of FIG. 3A in response to a force from right to left.

When the drift is below a predetermined value for a given structure, the strain is in the elastic regime and the energy stored is returned when the stress is removed in the form of reverse movement of the frame (i.e., kinetic energy).

However, when the drift exceeds the predetermined value, the girder begins to yield inelastically and energy is dissipated as heat while the material changes character by becoming hardened. After repeated cycles of post-yield stresses the material is ultimately susceptible to rupture. In major earthquakes (DBE), it has been observed that there are only two or three cycles of the highest magnitude which will likely push a structure to go into inelastic yielding.

In the case of the welded joints, it was assumed, based on a limited number of tests, that the welded connection will be stronger than the parent metal. In the event of large earthquakes, the steel in the girder will yield inelastically and thus absorb energy and provide damping to the structure. The 1990 Northridge Earthquake in Southern Calif., USA and a short time later the Kobe Earthquake in Japan have showed the assumed ductility (i.e., ability for the frame to continue displacing after the girder column joint had reached the yield point in steel and thus absorb energy) was not achieved in a large number of joints. This led to further research and new connection joints were developed. However, even after a good deal of testing, only a few type of joints have been tested and confirmed to have sufficient ductility that is required to absorb energy from the earthquakes by the inelastic rotation of the joint. During the inelastic rotation of the joint, the girder behaves in a flexural manner by bending slightly near the joints. One type of joint that is now considered desirable is one where the girder incorporates a weaker spot at each end near but slightly away from the joint. This weak spot is known as Reduced Beam Section ("RBS"), also known as "dog bone". The incorporation of RBS in the girder allows better control of the yielding of the girder away from the region of material that may have been modified by the formation of a joint and its welding.

Two seismic design criteria have been established by the structural engineering profession. The Design Basis Earthquake ("DBE") is defined in statistical terms as an earthquake event that has less than 10% likelihood of being exceeded in the economic life of the structure, deemed for most civil structures as 50 years. On the other hand, the Maximum Capable Earthquake ("MCE") is defined as an event that has less than 10% likelihood of being exceeded in 100 years. Beyond these two design criteria, there are no defined expectations for most structures except the overall goal is to prevent collapse.

It has been established in building practices that a building should be sufficiently stiff not to suffer more that 0.3% to 0.6% drift elastically. In terms of the moment frame, it approximately translates to 0.2% rotation in the elastic regime. This will prevent the building from straying uncomfortably under wind loads and to recover after mild to moderate earthquakes.

Moreover, the columns and girders of a moment frame should be proportioned such that in the event of an earthquake, it enters into the inelastic regime beyond a predetermined amount of rotation. When the DBE design goal is applied to a moment frame, the rotation in the girder at the column joint for the onset of inelastic yielding has been predetermined to be 3%. This allows the structure to translate laterally approximately in the 1.5% range in addition to the 0.3% to 0.6% range allowed for the elastic case. This range of approximately 2% total structure drift is regarded in the structural engineering profession as acceptable in the event of a large earthquake such as that of a DBE.

In most buildings used for commercial purposes, such as office buildings, the floor-to-floor height is usually between 13 feet and 14 feet. The exterior of the building usually has a glass window that is 7 feet in height. Thus, there exists a space of approximately 6 to 7 feet vertically for the girder to be fit in the perimeter moment frames. Also, in the core of the structure a similar height is available. In hospitals, convention centers and other special use buildings, story heights are typically 18 feet or greater, which allow a even larger space for girders in each story. The moment frames normally have a column spacing that varies from 20 to 40 feet. Thus, the girder length is usually 1.5 times to 3 times the length of the columns. In the traditional older structures, W14 columns were used and they matched the stiffness of the deeper girders, usually in the range of W24 to W36 members. These columns were used for moment connections in the two orthogonal directions for what is called a "two way moment frame" system.

Since the early 1960s, wider shape columns, i.e., W24 to W36 series in rolled shapes, have been introduced in buildings. The same types of I-beams are also being used for the girders in a perimeter frame to reduce tonnage of steel for the building frames. Today, these shapes are used by many engineers in even single frames, without using the full perimeter frame. Used in this way, the shorter column lengths have larger stiffness than the girders of similar depth.

Generally, two considerations enter into the design of a moment frame. The first consideration is the stiffness ratio between column and girder, which is related to efficiency and economy. The second consideration is the strength ratio between column and girder, which is related to desired behavior in the event of an earthquake. These two considerations are somewhat in conflict with each other.

It has been established that a girder to column stiffness ratio of unity is efficient, i.e., it reduces the total tonnage of steel used in the frames since the frames are generally governed by the elastic stiffness requirements of building codes for lateral loads and not by the state of stress. However, use of deeper girders, which will accomplish the goal of a stiffness ratio of unity between girders and columns, also leads to making the girders stronger than the columns. Since in taller buildings, the column shape selected is often W36, which is near to the maximum depth of rolled shapes, girders will need to be plate-fabricated to shapes of greater depths which add significantly to cost. A deeper girder will be stronger than the column. A girder stronger than the column is undesirable in the behavior of the frame as it can lead to individual story collapse in an earthquake. Building codes therefore expressly forbid the use of a strong girder with a weak column in buildings that rely on the rigid frames to resist earthquakes.

While a conventional frame structure using a single girder per floor level does provide some degree of seismic dissipation by the mechanism of flexural inelastic yielding, there is always the desire to have structures with even better dissipation of seismic energy which are also economic to build and have high performance.

OBJECTS AND SUMMARY OF THE INVENTION

It is therefore a general object of the invention to provide an improved framed structure and method therefor capable of enhanced dissipation of seismic energy.

It is another general object of the invention to provide an improved framed structure and method therefor that are economical and high performance.

It is an object of the invention to provide an improved framed structure that offer improved dissipation of seismic energy and yet is relatively stiff and light weight.

It is an object of the invention to provide an improved framed structure and method therefor that are easy to fabricate and assemble.

It is another object of the invention to provide an improved framed structure and method therefor that allows easy post-earthquake inspection and assessment of damage.

It is another object of the invention to provide an improved framed structure and method therefor that allows easy post-earthquake repair of damage in the framed structure.

These and other objects of the invention are accomplished briefly by having a rigid framed structure that incorporates the Coupled Girder Moment Resisting System ("CGMRS") of the invention. Such a framed structure includes at least a pair of spaced-apart girders supported by a pair of adjacent columns. The pair of spaced-apart girders are coupled by at least one, and preferably two girder-to-girder links such that when a drift develops in response to seismic energy input to the rigid frame structure, and when said drift exceeds an elastic limit, each of the girder-to-girder links yields inelastically to dissipate substantial portion of the seismic energy.

Various preferred embodiments ensure the integrity and stability of the girder-to-girder links and girders under yielding stress so that the girder-to-girder links can perform its energy dissipation function as intended.

CGMRS solves the problems of a) poor performance of the frame joints, b) girder stiffness deficiency and c) energy dissipation deficiency. It provides a higher level of redundancy, a concept desirable in the reliability of the earthquake resisting systems. Redundancy in building structure implies greater number of elements resisting the loads such as earthquake (or seismic) loads so that the likelihood of failure of the structure as a whole in each story of the building is reduced simply by the multiplicity of resisting elements.

In the elastic stage of drift of the structure, 5% damping is generally available. In the inelastic stage of drift, 20% damping is generally attained at 1.5% inelastic rotation of the girders due to flexural yielding.

By having the girder-to-girder links yielding earlier, the CGMRS provides an additional 3% to 5% damping to the structure provided by the damping from the conventional flexural yielding of the girders. This is in addition to the about 5% to 20% damping described earlier. Thus, by enabling yielding from the girder-to-girder links in the early stages of the inelastic behavior of the structure during a major earthquake, the demand on the balance of the structure is reduced. Thus, damage to the structure can be controlled such that the links provide added safety to the structure.

The vertical links can be relatively inexpensively repaired, both due to easier access, i.e., the vertical links are not covered by the floor concrete such as is the case of the girder top flange, as well as because the vertical links are connected to girders using simpler and smaller connections. In addition, the repair of the girder-to-girder links or vertical links will not involve applying heat to the columns nor require shoring of the girder in most cases.

Since the links are also providing additional stiffness and strength, the added damping makes it possible to have a lighter, stronger and more damage resistant frame than the conventional single girder frames or a coupled girder that is designed only for the stiffness and strength.

Additional objects, features and advantages of the present invention will be understood from the following description of its preferred embodiments, which description should be taken in conjunction with the accompanying drawings.

DETAILED DESCRIPTION OF THE PREFERRED EMBODIMENTS

The Coupled Girder Moment Resisting System ("CGMRS")

Figure 1:
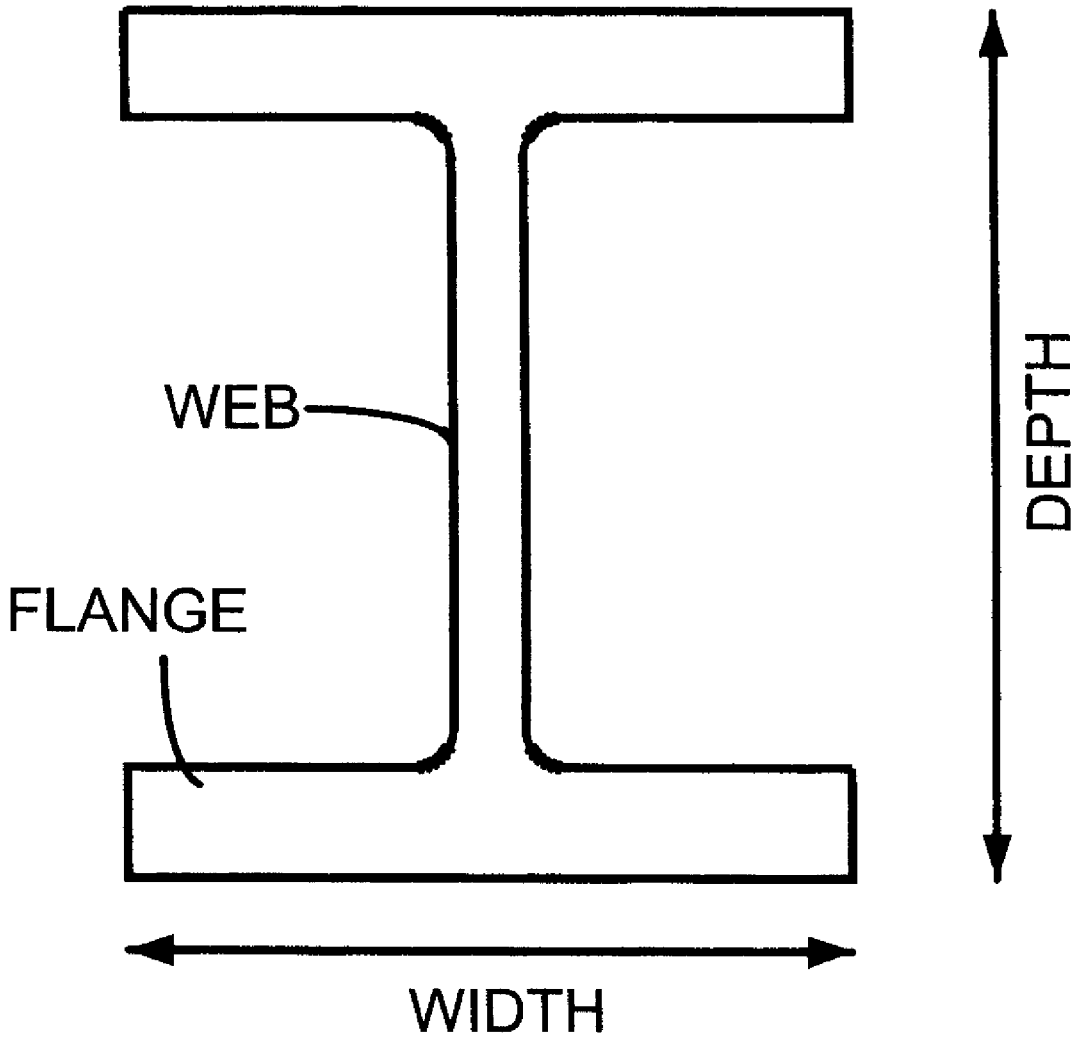
FIG. 1 illustrates a cross-sectional view of a modern steel I-beam that is used to form columns and girders of a framed structure.
Figure 2:
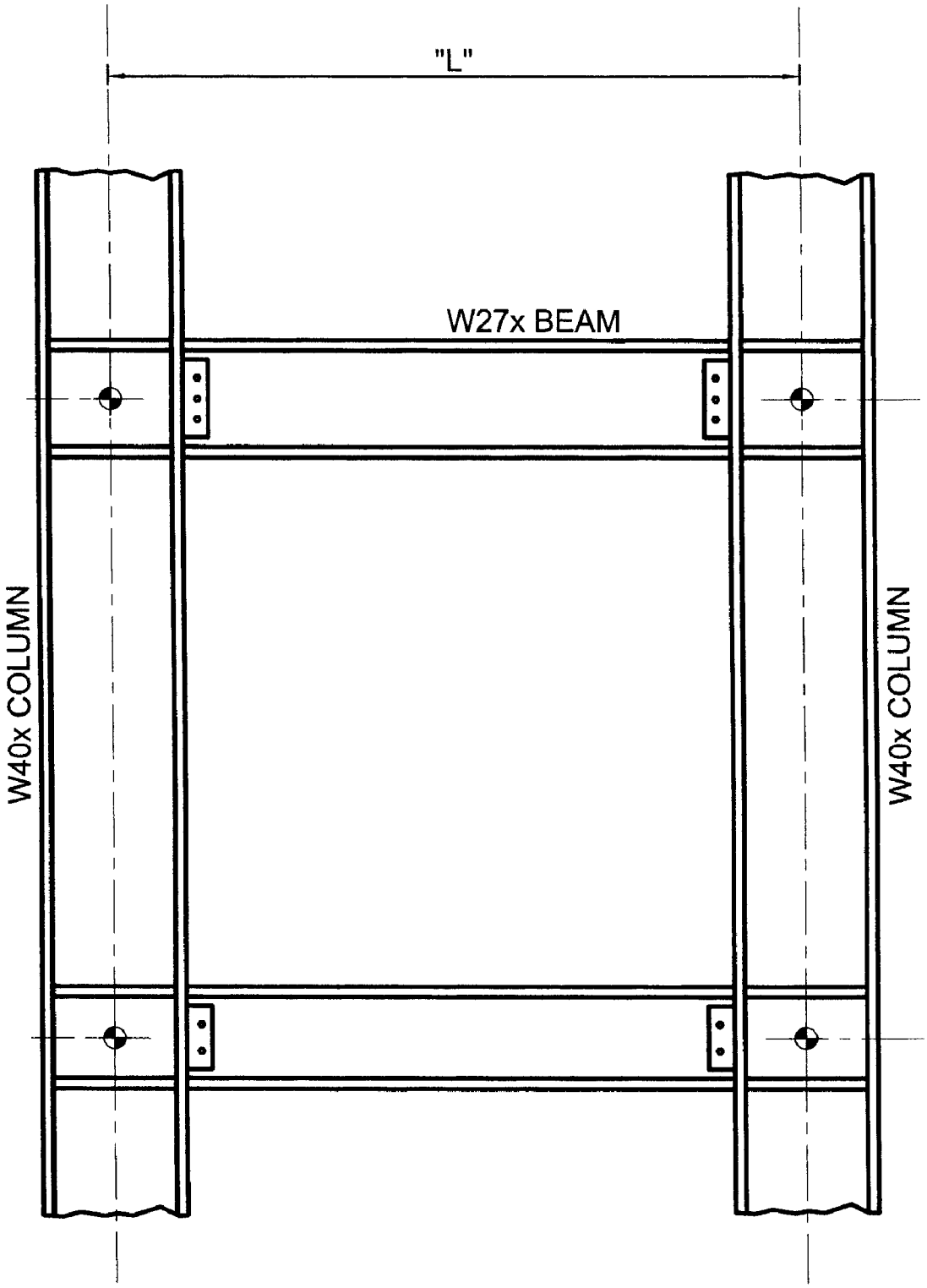
Fig. 2 (Prior Art)
FIG. 2 illustrates a conventional framed structure formed by a lattice of columns and girders.
Figure 4:
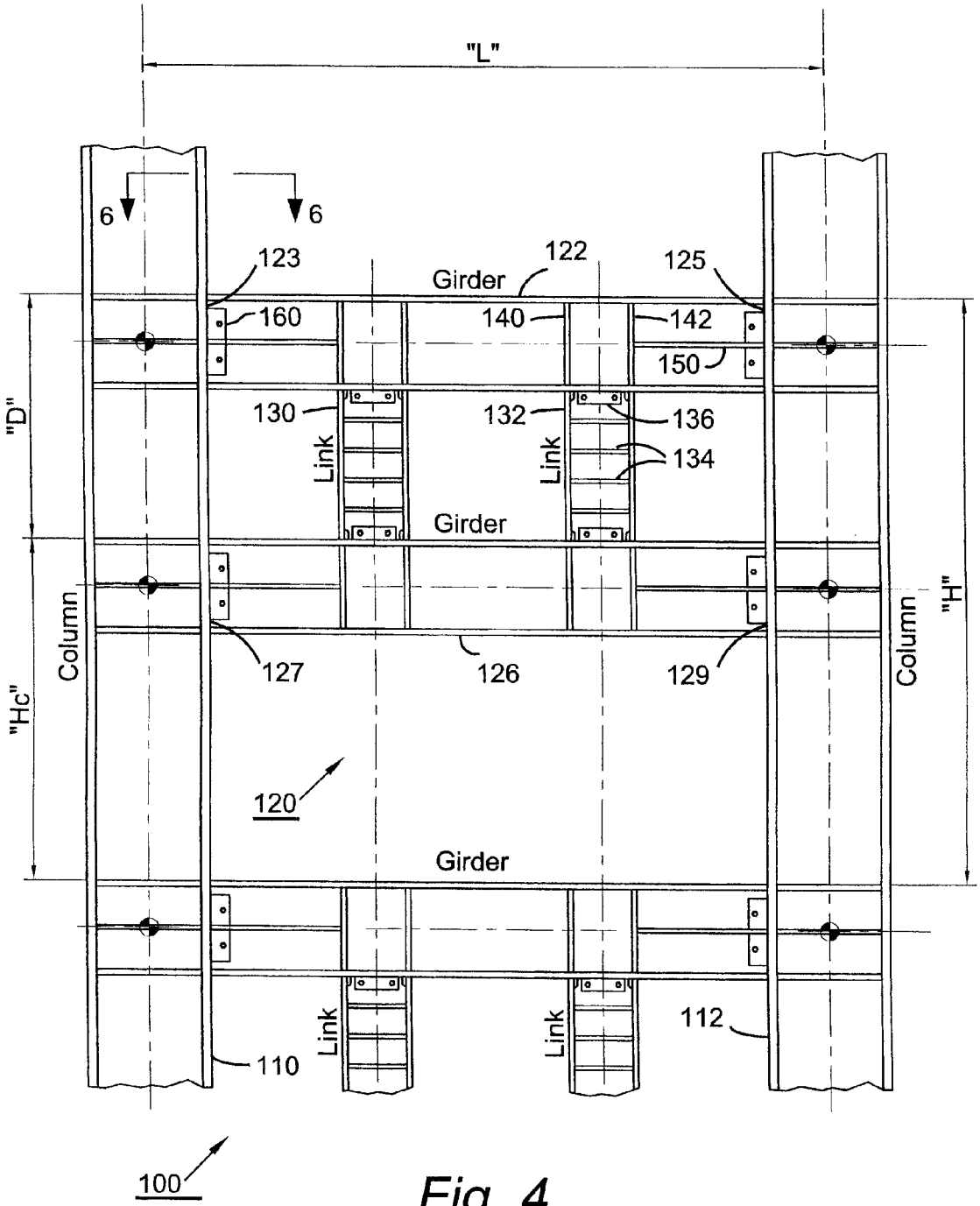
FIG. 4 illustrates a framed structure incorporating a coupled girder moment resisting system, according to a preferred embodiment of the invention.

FIG. 4 illustrates a framed structure incorporating a coupled girder moment resisting system ("CGMRS"), according to a preferred embodiment of the invention. A frame structure incorporating CGMRS is different from that of a conventional system shown in FIG. 2 in several respects. First, it has two girders coupled together per floor level. Secondly, the two girders are coupled in such a way that it is able to provide the desired seismic dissipation as will be described in more detail later.

Double girder systems that are rigidly coupled have been employed by Rajendra Sahai in the Bank of America Data Center, Concord, Calif., USA in 1982. However, the rigid couplings between the double girders were designed to increase the stiffness and elastic strength of the double girder and not designed to have the damping mechanism of the present invention.

FIG. 4 shows, for simplicity and not to scale, one floor section of a framed structure 100 which in general will be multi-floor and form a three-dimensional lattice of columns and girders or form a perimeter frame (i.e., one plane frame from each side of building either disconnected or connected to other frames at the corners of the building.) Adjacent columns 110, 112 support a coupled girder system 120 on each floor. The coupled girder system 120 or CGMRS comprises girders 122, 126 that are coupled together by one or more girder-to-girder links that are capable of dissipating energy in the event the framed structure has rotated beyond a predetermined amount. In the preferred embodiment, two girder-to-girder links are employed and they are in the form of vertical links 130, 132. The girder 122 has girder ends 123, 125 and the girder 126 has girder ends 127, 129. The coupled girder system 120 is connected to the two columns 110, 112 by the girder ends 123, 125, 127, 129.

As described earlier, for commercial buildings the floor-to-floor height is usually between 13 and 14 feet. This can provide a living height of 8 feet and still allow a depth of approximately 6 feet or more for the double girders 122, 126. The girders are placed in the same plane as the web of the columns and are separated by a spacing that varies between 0.5 to 2.0 times the depth of the girders.

In the preferred embodiment, the two vertical links 130, 132 are placed evenly across the span of the girders and thus at one third points in the span. The vertical links are welded to the girders in the moment frame type of connection. Each vertical links is preferably made from a vertical I-shape member, either fabricated from plates or using a wide-flange rolled shape. Thus, each vertical link has a web terminated at its left and right sides by a flange.

Figures 5A, 5B, 5C:
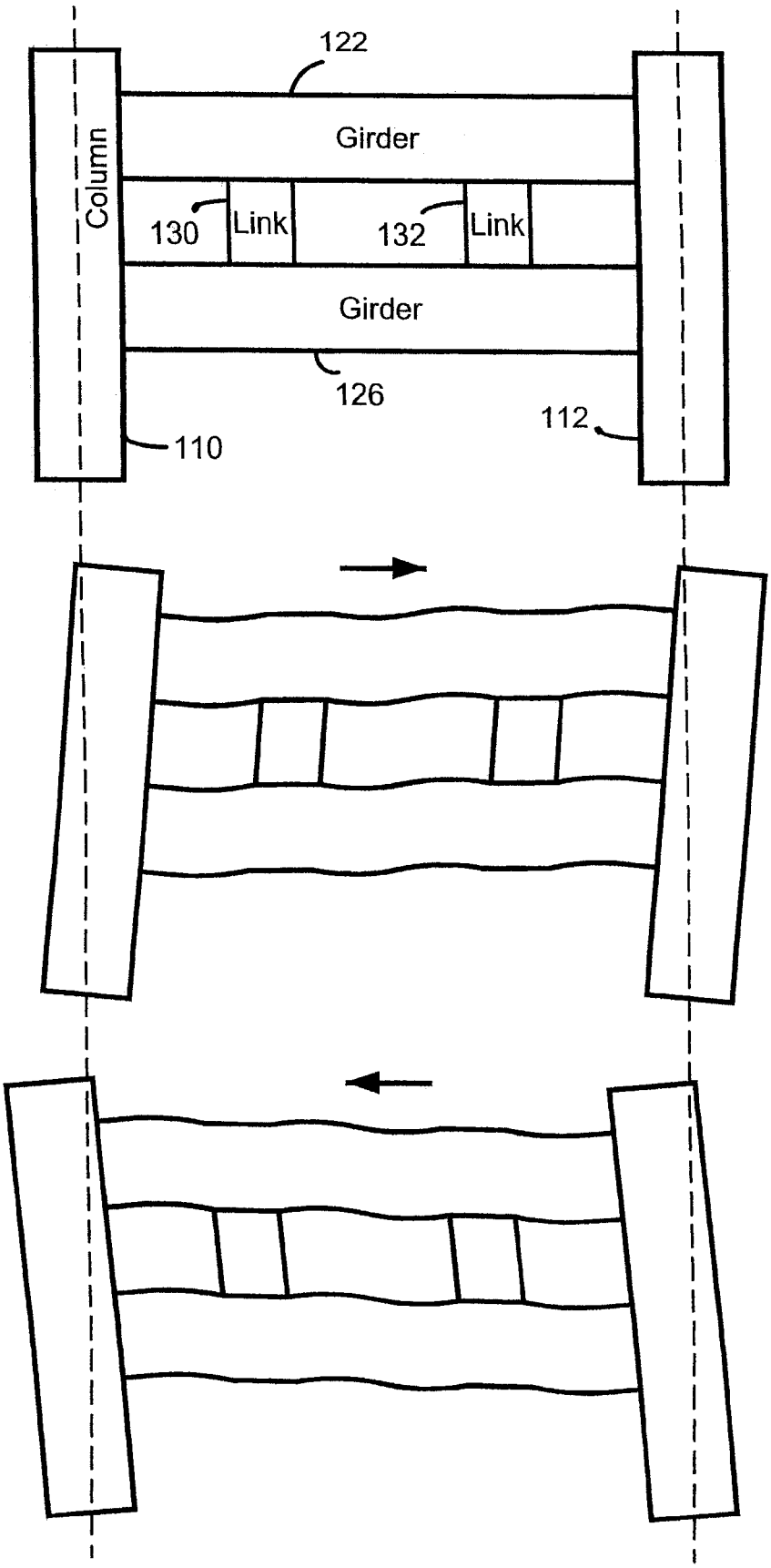
FIG. 5A is a schematic representation of the framed structure incorporating the coupled girder moment resisting system (CGMRS) shown in FIG. 4 for the purpose of illustrating its behavior under drift.
FIG. 5B illustrates schematically the deformation to the CGMRS framed structure of FIG. 5A in response to a force from left to right.
FIG. 5C illustrates schematically the deformation to the CGMRS framed structure of FIG. 5A in response to a force from right to left.

FIG. 5A is a schematically representation of the framed structure incorporating the coupled girder moment resisting system (CGMRS) shown in FIG. 4 for the purpose of illustrating its behavior under drift.

Figures 3A, 3B, 3C:
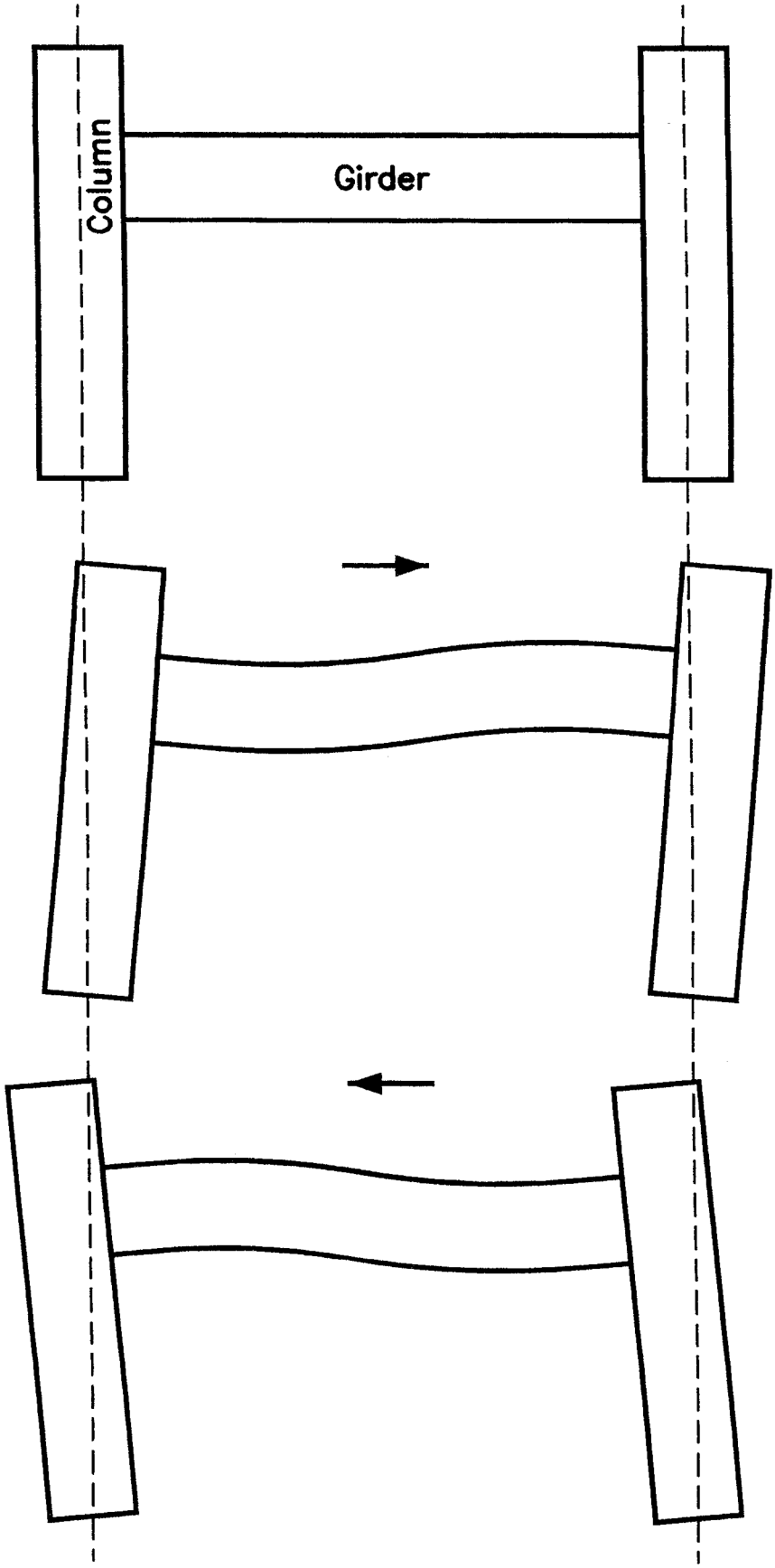
Fig. 3A PRIOR ART
Fig. 3B PRIOR ART
Fig. 3C PRIOR ART
FIG. 3A illustrates schematically a simple conventional framed structure formed by a girder supported by two columns.
FIG. 3B illustrates schematically the deformation to the conventional framed structure of FIG. 3A in response to a force from left to right.
FIG. 3C illustrates schematically the deformation to the conventional framed structure of FIG. 3A in response to a force from right to left.

FIG. 5B illustrates schematically the deformation to the CGMRS framed structure of FIG. 5A in response to a force from left to right. FIG. 5C illustrates schematically the deformation to the CGMRS framed structure of FIG. 5A in response to a force from right to left. When there is a drift in the frame structure 100, the double girder 122, 126 will have flexural stress and strain as described in connection with FIGS. 3A–3C. In addition, because of the differential displacement of the double girders, the web of the two vertical links will be subject to shear stress and strain. This has two effects. First, the shear in the vertical links helps to store some of the energy, and in the limit of inelastic yielding contributes to dissipating the energy as desired. Secondly, the shear force will result in a net axial force load on the girders.

The vertical links 130, 132 are proportioned to behave elastically until the drift of the frame structure has exceeded a predetermined value after which they will go into the inelastic regime. The predetermined value is set in the lower bound by the consideration similar to that for the girder-to-column joint, namely, the shear in the web of the vertical links behaves elastically for the building code prescribed for wind loads and mild to moderate earthquakes. The predetermined value is set in the upper bound preferably by requiring the web of the vertical links to yield no later, and more preferably prior to, the flexural yielding at the girders. In this way, seismic energy is first dissipated by the yielding of the vertical links before the flexural yielding of the girders. If the yield strains are very large or repeated over many cycles, the vertical links will be damaged before the girders.

Structural Stability & Integrity Under Stress

In order to implement the feature of the shear yielding of the web of the vertical links and ensure the resulting dissipation of energy, the integrity and stability of both the vertical links and the girders must be ensured during the shear yielding.

Since, a girder is already subject to flexural load, the axial force due to the shear in each vertical link places additional load on the girder. It has been found that the axial load is preferably limited to below 35% of the axial capacity of the girder. In this way, 65% of the capacity remains for the flexural load and the integrity and the stability of the girder is ensured.

Referring to FIG. 4, the vertical link such as 130 or 132 is preferably fabricated in such a way that essentially the web portion of it shears in a controlled manner. In the preferred embodiment, a series of horizontal stiffeners 134 parallel to the shear direction each has it edges welded onto the web and the inner flanges of the vertical link. This structure will prevent the web of the vertical link from buckling during the shear. The vertical link is connected to the girders in a manner similar to that between a girder and a column. Preferably, a stiffener plate 136 is welded to the flange of the girder 122. The vertical link 132 is then bolted through its web onto the stiffener plate 136. Then the edges of the vertical link 132 are welded to the flange of the girder. The stiffener plate 136 is also welded to the web of the vertical link. The stiffener plate 136 serves to strengthen the joint between the vertical link and the girder and the portion of the vertical link's web adjacent the joint. It essentially confines the yield in shear only to the portion of the web away from the joints, thereby ensuring stability of the vertical link and its connection to the girders.

Similarly, the portion of the girder adjacent to each vertical link is strengthened by two stiffener plates such as 140, 142 welded to adjacent portion of the web and inner flanges of the girder 122. It is as if the flanges of the vertical link are extended across the girder flange. In this way, the portions of the girder adjacent the vertical links 130, 132 are reinforced to ensure structural stability of the girder under shear stress from the vertical links.

Also, the flexural stress in the vertical link's flange should preferably not exceed 80% of its yielding stress while the vertical link is shear yielding. This helps to ensure structural integrity of the link.

In the preferred embodiment, the girder such as the girder 122 is strengthened by a center strengthening bar 150 near the girder-to-column joint. The center strengthening bar 150 is installed running parallel to a central line of the girder's web between the column flange at the girder-to-column joint 125 and the stiffener plate 142. The central strengthening bar 150 is welded at its edge adjacent to the web of the girder 122 and to the surfaces of the column flange and the stiffener plate 142. This will strengthen the girder at the critical portion near the column joint and keep the axial stress ratio under control, thereby ensure the stability of the girder and help prevent it from buckling.

The two girders and the vertical links can be preassembled and welded in the shop. This will reduce cost and maintain high quality and reliability. The coupled girder system is erected as a single member requiring four smaller girder-to-column connections at the columns.

The girder-to-column connection is essentially similar to that prescribed for a conventional SMRF joint. FIG. 4 shows a stiffener plate 160 welded to the flange of the column 110. The girder end 123 is bolted to the stiffener plate 160 and its web is fully welded to the flange of the column. Similar joints are effected at the other girder ends 125, 127 and 129 of the coupled girder system.

In the preferred embodiment, additional features are implemented at the girder ends to ensure proper behavior of the girder under yielding stress. As mentioned earlier, after the Northridge earthquake, the preferred practice is to incorporate a weak spot, RBS or "dog bone" near the joint section of the girder to allows better control of the yielding of the girder away from the joint.

Figure 6:
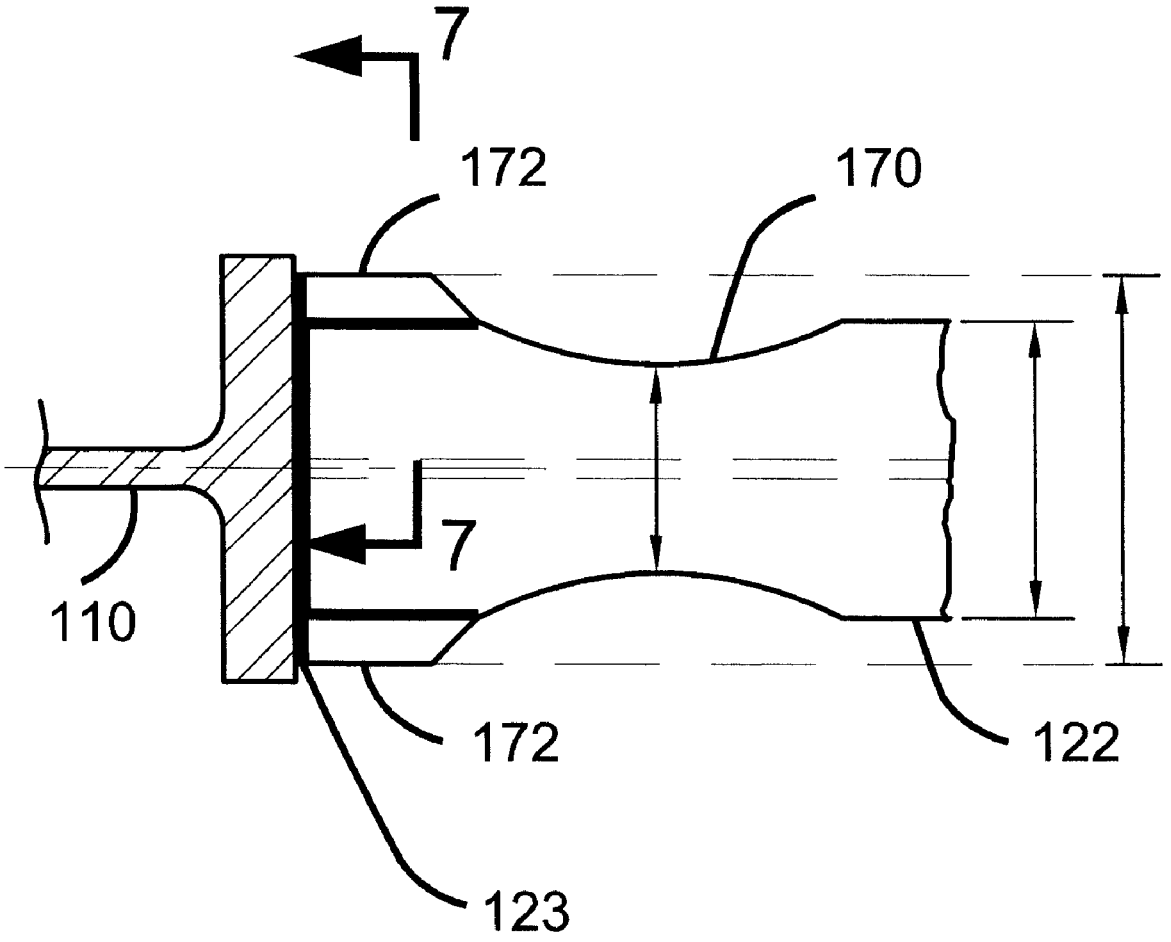
FIG. 6 is a detailed sectional view of the joint between a girder and a column along the section 6—6 shown in FIG. 4.

FIG. 6 is a detailed sectional view of the joint between a girder and a column along the section 6—6 shown in FIG. 4. The girder 122 has a reduced beam section (RBS) 170 in the flange near the girder end 123. To ensure that the yielding will take place in the RBS and away from the joint, the reduced section can be made sufficiently small in the range of 0.5 to 0.6 of the width of the girder. Alternatively, if the reduction is 0.7 times the width or wider, the stiffness and strength of the girder can be made higher to maintain the contrast in strength between the joint and the RBS. This is accomplished by further strengthening the joint region of the girder by extending the width of the girder there with wing plates 172.

Figure 7:
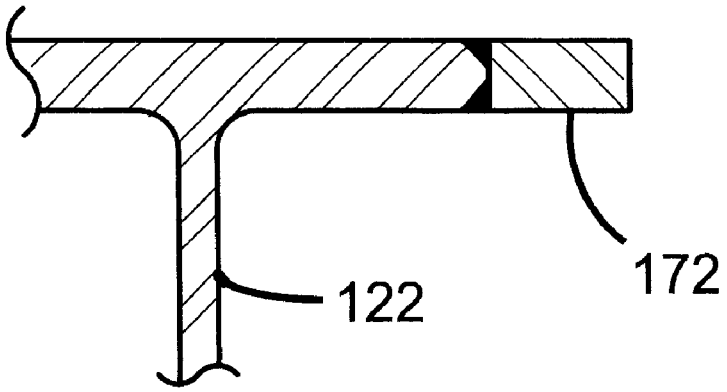
FIG. 7 is a detailed sectional view of the wing extension to the girder flange, along the section 7—7 shown in FIG. 6.

FIG. 7 is a detailed sectional view of the wing extension to the girder flange, along the section 7—7 shown in FIG. 6. The wing plates 172 are welded in-line with the flange on both side of the girder and serve to extend the width of the flange there. It has been found for the flange widths at the joint and at the RBS, a ratio of 2 to 1 is satisfactory in ensuring the proper functioning of the RBS.

By ensuring the structural stability and integrity of the girders and the vertical links under stress, the features of the invention can be implemented. Thus, the girders remain primarily in the flexural behavior and the links primarily in the shear behavior. The development of the yield in the web shear of the links precedes the development of the girder yield in flexure and the inelastic rotation demand in the girder remains low (between 1% to 2%), while the inelastic rotation demand in the links is higher (between 4% to 8%) for the DBE.

By placing the vertical links ahead of the girder inelastic behavior, the primary structure's moment connections fall back in line of defenses to be employed, potentially reducing costs of post earthquake repairs. The vertical links can be relatively inexpensively repaired, both due to easier access, i.e., the vertical links are not covered by the floor concrete such as is the case of the girder top flange, as well as because the vertical links are connected to girders using simpler and smaller connections. In addition, the repair of the girder-to-girder links or vertical links will not involve applying heat to the columns nor require shoring of the girder in most cases. For all these reasons, CGMRS, is beneficial to the owner in reducing potential future costs of repair in the event of a major earthquake.

It is anticipated that if the structure is designed to be immediately occupiable after a DBE event, the post elastic rotation at the DBE in the vertical links for most structures will be less than 2%, while the rotation in the girders will be less than 1.0%. For the MCE, the inelastic rotations in the vertical links and girders will be less than 3% and 1.5% respectively. Damage to the structure can be controlled by setting the limits of drift and proportioning members and the amount of inelastic rotation demands on the girder and links. For the MCE, generally the damage control is not attempted, except to maintain frame stability.

There is an additional benefit of the double girder system in that it effectively increases the stiffness of the column as well as that of the girder. The two girders in depth increase to between 2.5 to 4 times the girder depth. This leads to reduction of the effective length of the column effectively increasing its stiffness as well as higher stiffness of the girders as a coupled girder. The stiffness matrix thus can approach the desirable number of unity.

Sample Test Results

Once the vertical links yield, certain amount of damping is introduced in the system, which is estimated at between 3% to 5%. This vertical link shear damping reduces the demand for the flexural yielding to follow in the girders at the columns, which further increases damping in the structure.

Table 1 summarizes the comparison between the performance and dissipation for a framed structure based on a 2-Bay, 3 -Story Model that respectively employs a single girder, a double girder and a coupled girder (CGMRS). It is clear from the table that the coupled girder system, in the example selected, will dissipate 35% to 70% more energy than the conventional single girder system and 30% to 70% more than the double girders used at each level of the structure.

Thus, the coupled girder system allows the structure to be lighter weight, because it is stiffer and stronger, and also to dissipate more energy. The mechanism of energy dissipation is that of shear yielding in the girder-to-girder links which has been shown to have very stable and predictable dynamic behavior and thus less likely to result in fractures needing repair.

Methodology

Similar to moment connection testing in SMRF, a testing program is preferably undertaken for the CGMRS to verify the rotation capability of both the link and the girders. At a minimum, two specimens of a single girder and link sizes should be tested using either a modified "Reduced Beam Section" (RBS, i.e., "dog bone") connection for the girder (FIG. 6). Also, two girder sizes should be tested, involving a total of four test specimens of the coupled girder system for any new project. In addition, four link-to-girder connection specimens need to be tested to measure the link rotation and connection integrity. A test protocol can be established for the connections of the coupled girder moment resisting system (CGMRS), similar to what is done for a SMRF girder-to-column connection testing.

The analytical procedures for the design of the frames is preferably performed by computer using standard commercially available software programs such as, ETABS or SAP 2000 (offered by Computers and Structures, Inc, Berkeley, Calif.) for the frame analysis to calculate the forces, deflections and stresses in the structural frame. Specific analyses include (1) Linear 3D Extended Three-dimensional Analysis of Building Structures ("ETABS") model analysis for the frame and using linear properties for all structural elements, including the vertical links for the 1997 Uniform Building Code specified loads; (2) DRAIN 2D Static Pushover analysis of the plane frame segments to verify Hinging sequence and, (3) DRAIN 2D Dynamic Pushover Analysis of the plane frame with elastic plastic properties of the vertical link using Time-History of the earthquake criteria.

The Coupled girder system (CGMRS) can be designed using the following methodology:

Step 1: A perimeter frame or if suitable a number of plane frames in the building is proportioned using old methodology of frame design. The frame needs to have the stiffness to resist lateral loads of wind and Uniform Building Code specified earthquake loads for elastic behavior of the structure. The strong column weak beam requirement when using a special moment resisting frame (SMRF) will need to met. Frame analysis is performed by standard computer software mentioned earlier.

Step 2: Two girders approximately half the unit weight of the girder in the proportioned frame above are then selected. This is followed by selecting a vertical link approximately two thirds the depth of the girder. The vertical links and girders are configured as shown in FIG. 4. The link shear initial yield capacity is limited to the less than or equal to approximately 20% of the axial yield capacity of the girder. The vertical link flexural strength needs to be large enough to assure shear yielding of the link prior to flexural yielding of the link by a ratio of at least 1.25 to 1.00. Due to repeated cycles of yielding, the vertical link develops strain hardening due to the working of the steel and thus reaches a capacity of approximately 50% to 70% higher than initial yield.

Step 3: The strong column-weak girder criterion must be maintained while taking into account the axial loads in the girder and verifying the strength of the girder and column based on the established principles of engineering.

Step 4: Since the Coupled Girder system is inherently a stiffer system, the member sizes may now be proportioned to a smaller girder and a smaller column sizes than selected in Step 3 above as long as the stresses in the components are at the acceptable levels using the elastic analysis procedure with the gravity loads and seismic loads that are appropriate to the elastic design procedure. The vertical link shear must remain also within the elastic limit, though it is better to have it approach close to the elastic limit in the elastic earthquake and wind loading procedures, such as prescribed in the Uniform Building Code (UBC), 1994 edition or 1997 edition. Drift ratio in the elastic design procedure are generally kept to 0.25% to 0.5% of height at each story both for wind loads as well as for the Uniform Building prescribed earthquake loads. The system reduction factor of Rw=12 using 1994 UBC or R=8.5 using 1997 UBC may be used to determine the forces for the Special Moment Resisting Frames (SMRF).

Step 5: Push Over analysis is then performed on the individual frames ( or collective assemblage of the frames), using standard computer software such as SAP-2000. The Push Over analysis provides the Capacity Spectra over which the Demand Spectra is superimposed. From the intersection of the two curves depicting the Capacity and demand, the performance point can be determined. In the Push Over Analysis procedure, the behavior of the inelastic response of the frame is clearly depicted step by step. The goal of a good design is to engage maximum number of joints, both the girder to column flexural joint with axial loads as well as the shear in the vertical links to yield prior to the stage where any of the joints approaches a failure. The desired sequence of yielding is shear in as many links as possible before girder yielding at the column joint.

Step 6: While the frame is being analyzed using the Push Over Design procedure, at each stage of the frame displacement, the effective damping can be calculated and thus it can be seen in the above Step 5, how well proportioned is the frame. As mentioned before, it is recognized in the profession that the horizontal frame displacements of 1% of height are desirable as a maximum displacement during a mild or moderate earthquake so as to not sustain non-structural damage. Damages to the exterior walls, partitions, ceilings and mechanical equipment etc are small enough that the building will likely be immediately occupiable. Also, for the structure, the immediate occupancy is defined in terms of the strain in the steel in the Federal Emergency Management Agency document FEMA-273. These indices can then be followed to reach the goals of the building performance. The frame thus proportioned to meet these goals will be the one that meets the displacement and strain limitations set for that building. In the structural engineering profession, that is then defined as the performance point of the building, where the Demand Spectra placed Capacity Spectra meet for a specified earthquake. The Demand Spectra is produced using an assumed damping ratio in the building. Generally this is assumed to be 5% in a linearly elastic steel structure, where the steel structure in its basic behavior provides 2% damping and the rest of the building elements such as the exterior walls, interior partitions and ceilings etc. provide the other 3% damping.

While the embodiments of this invention that have been described are the preferred implementations, those skilled in the art will understand that variations thereof may also be possible. Therefore, the invention is entitled to protection within the full scope of the appended claims.

TABLE 1

Summary of Comparison Between Single Girder, Double Girder and Coupled Girder Systems Based on a 2-Bay, 3-Story Model

| | | | SINGLE GIRDER | DOUBLE GIRDER | COUPLED GIRDER |
|---|---|---|---|---|---|
| 1. | Elastic Stiffness (for wind and moderate earthquake behavior) | | 48.0 (kips/inch) | 59.0 (kips/inch) | 90.0 (kips/inch) |
| 2. | Elastic Plastic Stiffness (major earthquake behavior) | | 40.4 (kips/inch) | 44.0 (kips/inch) | 55.0 (kips/inch) |
| 3. | Strength (large earthquake collapse prevention) | | 970.0 (kips) | 1150.0 (kips) | 1380.0 (kips) |
| 4. | Energy Dissipation * Capacity @ 1% drift | | 5.0% | 5.0% | 8.5% |
| | Energy Dissipation* Capacity @ 1.5% drift | | 9.0% | 9.4% | 12.3% |
| | Energy Dissipation Capacity @ 2.0% drift | | 17.0% | 14.8% | 23.0% |
| 5. | Weight | Columns | 157,219 | 157,219 | 157,219 |
| | | Girders | 26,726 | 24,883 | 24,883 |
| | | Links | — | — | 7,180 |
| | | Total | 186,945# | 182,102# | 189,283# |
| 6. | Cost | | $367,891 | $364,204 | $392,927 |

* Measured at percent of critical.
Drifts noted are "spectral."

It is claimed:

1. A rigid framed structure comprising:

first and second columns;

at least two spaced-apart girders, each having first and second girder ends connected respectively by a girder-to-column coupling to said first and second columns; and at least one girder-to-girder link substantially orthogonal to a long axis of said at least two spaced-apart girders for coupling therebetween;

wherein whenever a drift in said rigid framed structure has exceeded a first predetermined value, said at least one girder-to-girder link dissipates seismic energy by inelastic shear yielding; and each of said spaced-apart girders has a depth and said spaced-apart girders has a spacing that ranges substantially from half to two times the depth of each girder.

2. A rigid framed structure as in claim 1, wherein said at least one girder-to-girder link includes two girder-to-girder links.

3. A rigid framed structure as in claim 1, wherein said at least one girder-to-girder link yields inelastically by shearing due to a differential displacement of said at least two spaced-apart girders under said drift that exceeds the elastic limit.

4. A rigid framed structure as in claim 1, wherein said at least one girder-to-girder link yields inelastically prior to other inelastic yielding in the framed structure.

5. A rigid framed structure as in claim 1, wherein said at least one girder-to-girder link yields inelastically prior to an inelastic yielding in a girder-to-column coupling of said at least two spaced-apart girders.

6. A rigid framed structure as in claim 1, wherein said at least one girder-to-girder link has a wide flange rolled shape in the form of an I-beam having a web between two flanges.

7. A rigid framed structure as in claim 6, wherein the web of the girder-to-girder link is reinforced by one or more stiffener plates parallel to a long axis of said at least two spaced-apart girders, said one or more stiffener plates being fully welded to the web and flanges of the girder-to-girder link.

8. A rigid framed structure as in claim 1, wherein said at least one girder-to-girder link is coupled to each of said at least two spaced-apart girders by welding together with a stiffener plate.

9. A rigid framed structure as in claim 1, wherein the portions of said at least two spaced-apart girders adjacent said at least one girder-to-girder link are strengthened with reinforcing plates.

10. A rigid framed structure as in claim 1, wherein said at least two spaced-apart girders have a portion adjacent each of said first and second columns that are strengthened with reinforcing plates.

11. A rigid framed structure as in claim 10, wherein said at least two spaced-apart girders comprises a reinforcing bar welded to the web thereof extending from a portion adjacent a column to a portion adjacent a girder-to-girder link.

12. A rigid framed structure as in claim 1, wherein said at least two spaced-apart girders comprises a reduced beam section near each of said first and second columns.

13. A rigid framed structure as in claim 12, wherein said at least two spaced-apart girders comprises an increased beam section substantially adjacent each of said first and second columns.

14. A rigid framed structure as in claim 13, wherein said increased beam section comprises at least one wing plate welded thereat to widen each of said at least two spaced-apart girders.

15. A rigid framed structure as in claim 1, wherein there are two girder-to-girder links located approximately at one-third points across a span of said at least two spaced-apart girders between said first and second columns.

16. A rigid framed structure as in claim 1, wherein said at least one girder-to-girder link yields inelastically and substantially contemporaneously with an inelastic yielding in a girder-to-column coupling of said at least two spaced-apart girders.

17. A rigid framed structure as in claim 1, wherein whenever said drift in said rigid framed structure has exceeded a second predetermined value, said pair of girder-to-column couplings dissipates seismic energy by inelastic flexural yielding.

18. A rigid framed structure as in claim 1, wherein said second predetermined value of drift is more than said first predetermined value.

19. A rigid framed structure as in claim 1, wherein said second predetermined value of drift is substantially equal to said first predetermined value.

20. A rigid framed structure as in claim 1, wherein said at least one girder-to-girder link has flanges at both ends, said flanges are subject to flexural stress when said girder-to-girder link goes into shear yielding, and said flexural stress is no more than eighty percent of a stress required to produce flexural yielding.

21. A method for providing seismic energy damping within a rigid framed structure, comprising:

providing a pair of girders, each having a depth;

forming a rigid framed structure by coupling at least said pair of girders to a pair of adjacent columns, while setting said pair of girders with a spacing that ranges substantially from half to two times the depth of each girder; and providing at least one girder-to-girder link coupling between said at least one pair of spaced-apart girders, such that said at least one girder-to-girder link dissipates the seismic energy by inelastic shear yielding in the event of flexing of the rigid framed stricture beyond a predetermined amount.

22. A rigid framed structure comprising:

first and second columns;

at least two spaced-apart girders, each having first and second girder ends connected respectively by a girder-to-column coupling to said first and second columns, and at least one girder-to-girder link substantially orthogonal to a long axis of said at least two spaced-apart girders for coupling therebetween; and wherein:

whenever a drift in said rigid framed structure has exceeded a first predetermined value, said at least one girder-to-girder link dissipates seismic energy by inelastic shear yielding;

said at least one girder-to-girder link has a wide flange rolled shape in the form of an I-beam having a web between two flanges;

the web of the girder-to-girder link is reinforced by one or more stiffener plates parallel to a long axis of said at least two spaced-apart girders; and said one or more stiffener plates is fully welded to the web and flanges of the girder-to-girder link.

23. A rigid framed structure comprising:

first and second columns;

at least two spaced-apart girders, each having first and second girder ends connected respectively by a girder-to-column coupling to said first and second columns; and at least one girder-to-girder link substantially orthogonal to a long axis of said at least two spaced-apart girders for coupling therebetween; and wherein:

said at least two spaced-apart girders have a portion adjacent each of said first and second columns that are strengthened with reinforcing plates; and said at least two spaced-apart girders comprises a reinforcing bar welded to the web thereof extending from a portion adjacent a column to a portion adjacent a girder-to-girder link.

24. A rigid framed structure comprising:

first and second columns;

at least two spaced-apart girders, each having first and second girder ends connected respectively by a girder-to-column coupling to said first and second columns; and at least one girder-to-girder link substantially orthogonal to a long axis of said at least two spaced-apart girders for coupling therebetween; and wherein:

said at least two spaced-apart girders comprises:

a reduced beam section near each of said first and second columns;

an increased beam section substantially adjacent each of said first and second columns; and at least one wing plate welded thereat to widen each of said at least two spaced-apart girders.

25. A rigid framed structure comprising:

first and second columns;

at least two spaced-apart girders, each having first and second girder ends connected respectively by a girder-to-column coupling to said first and second columns; and at least one girder-to-girder link substantially orthogonal to a long axis of said at least two spaced-apart girders for coupling therebetween; and wherein:

said at least one girder-to-girder link has flanges at both ends, said flanges are subject to flexural stress when said girder-to-girder link goes into shear yielding, and said flexural stress is no more than eighty percent of a stress required to produce flexural yielding.

* * * * *